US009227095B2

(12) United States Patent
Tamburro

(10) Patent No.: US 9,227,095 B2
(45) Date of Patent: Jan. 5, 2016

(54) CLOTHES DRYER VENT COUPLING

(71) Applicant: Dennis Tamburro, Milmay, NJ (US)

(72) Inventor: Dennis Tamburro, Milmay, NJ (US)

( * ) Notice: Subject to any disclaimer, the term of this patent is extended or adjusted under 35 U.S.C. 154(b) by 188 days.

(21) Appl. No.: 14/187,731

(22) Filed: Feb. 24, 2014

(65) Prior Publication Data

US 2015/0240410 A1 Aug. 27, 2015

(51) Int. Cl.

*D06F 58/20* (2006.01)
*A62C 3/00* (2006.01)
*A62C 2/00* (2006.01)

(52) U.S. Cl.

CPC ... *A62C 3/00* (2013.01); *A62C 2/00* (2013.01); *D06F 58/20* (2013.01)

(58) Field of Classification Search

CPC ..... D06F 58/00; D06F 58/06; D06F 58/20; F26B 21/00; F26B 21/06
USPC ..... 34/595, 601, 602, 610; 68/5 C, 5 R, 19, 68/20; 8/139, 149, 159; 285/9.1, 179, 183
See application file for complete search history.

(56) References Cited

U.S. PATENT DOCUMENTS 2,809,025 A * 10/1957 Pettyjohn ..... D06F 58/22 34/604
3,383,115 A * 5/1968 Eckley ..... F27B 7/24 277/402
5,257,468 A * 11/1993 Lebrun ..... D06F 58/00 285/189
5,584,129 A * 12/1996 Williamson ..... D06F 58/20 34/134
5,653,631 A * 8/1997 Andersen ..... F24F 13/0209 34/235
6,098,312 A * 8/2000 Tuggle ..... D06F 58/20 285/183
6,195,910 B1 * 3/2001 Robineau ..... D06F 58/20 34/235
6,463,673 B1 10/2002 Gherna
6,584,702 B2 7/2003 Irey
7,421,804 B1 * 9/2008 Hession ..... D06F 58/20 34/601
7,442,120 B2 * 10/2008 Poirier ..... F16L 37/26 285/325
7,627,960 B2 * 12/2009 Beyerle ..... D06F 58/04 34/602
8,434,243 B2 * 5/2013 Kim ..... D06F 39/005 34/606
8,661,707 B2 * 3/2014 Dittmer ..... D06F 58/04 34/606
2005/0052018 A1 3/2005 Pichotta
2015/0240410 A1 * 8/2015 Tamburro ..... A62C 2/00 169/56

FOREIGN PATENT DOCUMENTS

DE EP 1990465 A1 * 11/2008 ..... D06F 58/04
DE 102007021815 B4 * 12/2011 ..... D06F 58/04
ES EP 2397602 A4 * 4/2015 ..... D06F 58/20

* cited by examiner

*Primary Examiner* — Stephen M Gravini
(74) *Attorney, Agent, or Firm* — Norman E. Lehrer

(57) ABSTRACT

A clothes dryer vent coupling system for connecting the vent outlet of a clothes dryer to an exhaust pipe in a room wall includes a rectangular housing secured to the wall and includes sides and a front wall. An outlet coupling on one side of the housing is connected to the exhaust pipe through rigid or flexible tubing. The front wall of the housing includes a round inlet opening facing forward. A connector coupling connected to the vent outlet at the back of the clothes dryer has a conical end but with openings therein. When the dryer is moved toward the room wall, the connector coupling is guided into and enters the inlet opening. Once in place, a rubber gasket around the connector coupling seals the coupling to the housing.

8 Claims, 2 Drawing Sheets

CLOTHES DRYER VENT COUPLING

FIELD OF THE INVENTION

The present invention is directed toward a vent exhaust system for clothes dryers and more particularly toward a dryer vent coupling system that allows for the easy hook up of a conventional household dryer to a venting system.

BACKGROUND OF THE INVENTION

The installation of a conventional household clothes dryer exhaust system into an external vent can be problematic due to the limited space available to perform the work. Generally, a dryer is installed in a space just wide enough to receive it. As a result, it is difficult to make the dryer vent exhaust system connection to the external vent once the dryer is positioned near the wall. If the dryer vent connection is made when the dryer is away from the wall, it frequently results in the dryer flexible vent tubing becoming crushed, flattened or kinked upon positioning the dryer close to the wall, resulting in poor airflow.

It is also known to be advantageous to employ rigid tubing for the dryer vent exhaust system rather than flexible tubing since it provides better air flow and tends not to flatten or kink. However, it is difficult to hook up rigid dryer vent tubing to the external vent system because the tubing and vent must be positioned exactly for a telescopic inner connection to be made.

Addressing these issues, a dryer exhaust vent system is disclosed in U.S. Pat. No. 4,967,490. This patent describes a dryer exhaust vent which locates reverse flow blocking vanes internally of the vent, in the vent housing, to serve as a closure for the inlet opening.

A universal dryer duct and vent is disclosed in U.S. Pat. No. 5,145,217. This patent discloses a dryer duct assembly which employs two universal elbow components so as to secure the dryer duct ventilation to the external wall.

Neither of these patents, however, addresses the problem of easy installation and a quick and easy connection of a dryer vent exhaust system employing rigid tubing into an external vent.

One attempt at providing a quick connect for a clothes dryer is described in U.S. Pat. No. 5,584,129. The invention described therein includes a pipe extending rearwardly from the back of the dryer that is intended to enter an exhaust socket built into the wall behind the dryer. The problem with this system is obvious. If the vent in the wall does not align with the dryer vent, no connection will be made. Furthermore, if the arrangement works for a particular dryer, it may not work if the dryer needs to be replaced.

There is, therefore, a need for a vent exhaust system for a dryer that is universal allowing substantially any home dryer to be quickly and easily connected or disconnected to the ventilation system.

SUMMARY OF THE INVENTION

The present invention is designed to overcome the deficiencies of the prior art discussed above. Accordingly, it is an object of the invention to provide a quick connector assembly between a dryer vent exhaust system.

It is a further object of the present invention to provide a quick connect and disconnect assembly that can be used with substantially any dryer.

It is a still further object of the present invention to provide a quick connect and disconnect assembly that can be used regardless of where in the room the outside exhaust pipe may be located.

In accordance with the illustrative embodiments demonstrating features and advantages of the present invention, there is provided a clothes dryer vent coupling system for connecting the vent outlet of a clothes dryer to an exhaust pipe in a room wall. The system includes a rectangular housing secured to the wall with the housing having four side walls and a front wall. An outlet coupling on one of the side walls of the housing is connected to the exhaust pipe through rigid or flexible tubing. The front wall of the housing includes a round inlet opening facing forward. A connector coupling connected to the vent outlet at the back of the clothes dryer has a conical end but with openings therein. When the dryer is moved toward the room wall, the connector coupling is guided into and enters the inlet opening. Once in place, a rubber gasket around the connector coupling seals the coupling to the housing.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
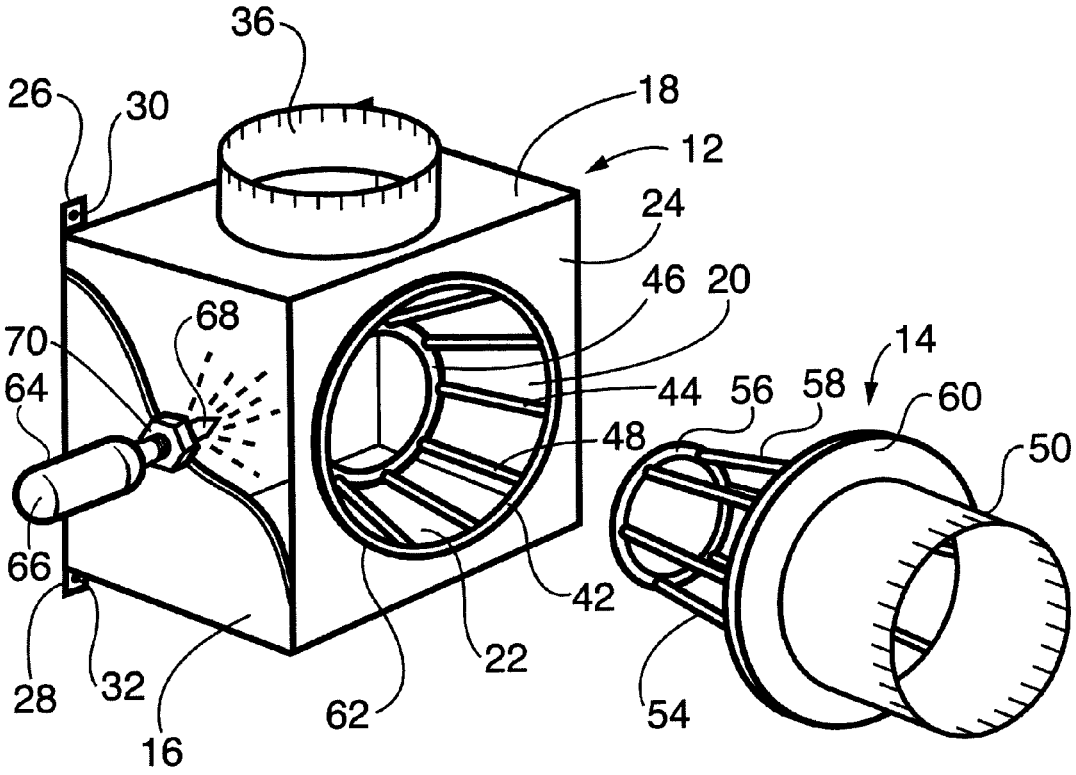
FIG. 1 is a front elevational exploded view of the dryer vent coupling system of the present invention.

Referring now to the drawings in detail wherein like reference numerals have been used throughout the various figures to designate like elements, there is shown in FIG. 1 a dryer vent coupling system constructed in accordance with the principles of the present invention and designated generally as 10. The dryer vent coupling system 10 is comprised primarily of two parts: a substantially rectangularly box-shaped housing 12 and a connector coupling 14.

The housing 12 includes four side walls 16, 18, 20 and 22. The housing 12 also includes a front wall 24 and may include a rear wall but the same is not absolutely necessary. In any event, the center or interior of the housing 12 is substantially hollow.

Tabs such as shown at 26 and 28 with apertures 30 and 32 therein are provided in each of the four corners of the rear of the housing 12. This provides a means for securing the housing 12 to the wall 34 (FIGS. 2 and 3) of a room by passing screws or the like through said apertures.

Figure 2:
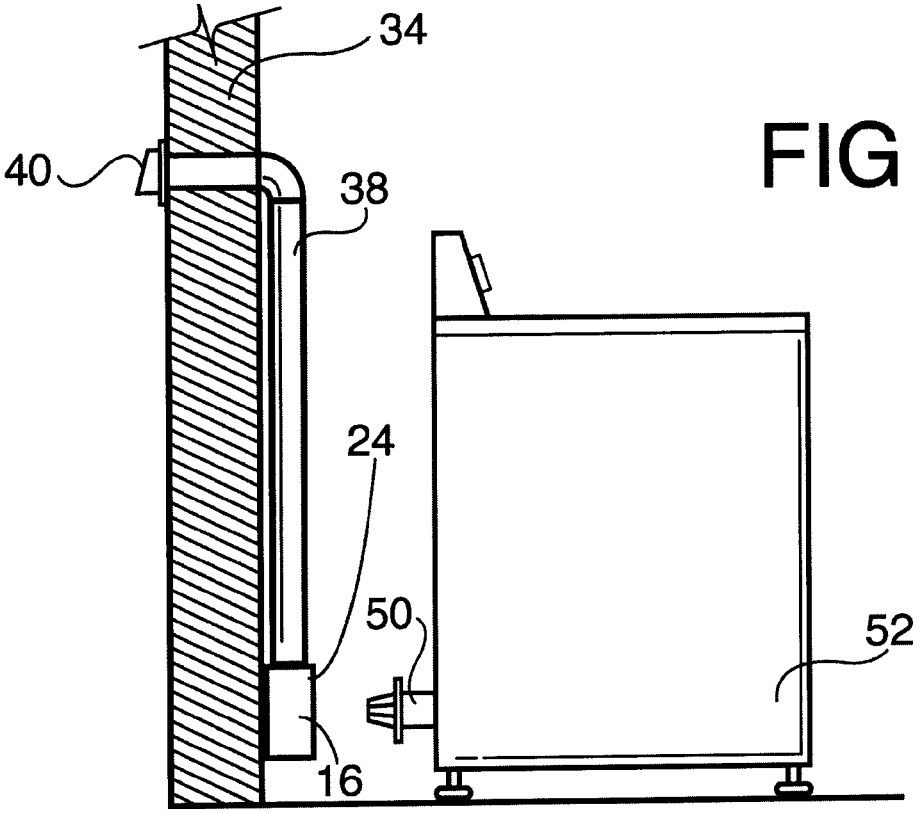
FIG. 2 is a side elevational view of the dryer vent coupling system of the invention attached to a dryer and to the room wall but with the dryer disconnected from the room exhaust.
Figure 3:
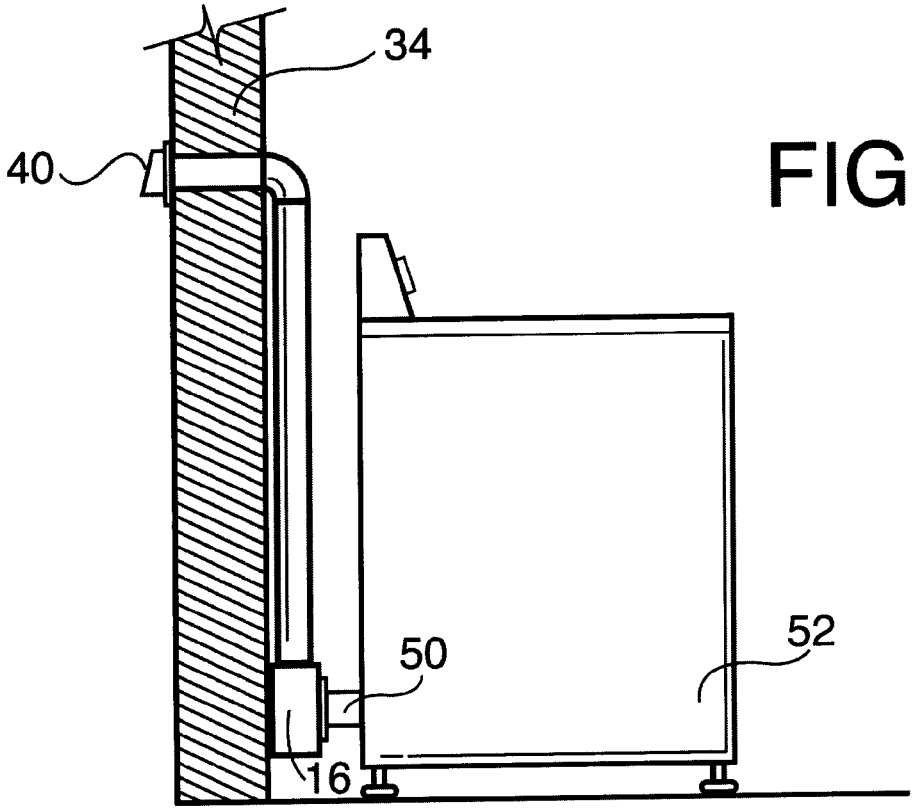
FIG. 3 is a side elevational view similar to FIG. 2 but with the dryer in place and the dryer vent exhaust coupling connected for the proper operation of the dryer.

As best shown in FIGS. 2 and 3, when the housing 12 is secured to the room wall 34, all of the side walls 16, 18, 20 and 22 are perpendicular to the room wall 34. The front wall 24 of the housing 12, however, is parallel to the room wall 34 but is spaced therefrom.

An outlet coupling 36 is mounted on one of the side walls of the housing 12. In FIG. 1, the coupling 36 is shown mounted in the side wall 18 which, in the orientation shown in FIG. 1, is at the top of the housing 12. It should be readily apparent, however, that all of the four side walls are essentially the same and that the coupling 36 could be mounted on any one of them. In any event, the coupling 36 is in the form of a short tube extending away from the housing but communicating with the interior of the housing 12.

The outlet coupling 36 is essentially the same as a standard dryer exhaust coupling and is adapted to be connected to an exhaust pipe 38. The exhaust pipe 38 extends to the vent 40 which passes through the wall 34 to the exterior of the room. The exhaust pipe 38 can be either a rigid pipe or a standard flexible hose such as commonly used with dryer venting systems.

Although the pipe 38 is shown extending out of the top of the housing 12 to the vent 40 that is positioned above, it should be readily apparent that the same could extend from either side of the housing 12 (or even downwardly in some applications). It is not necessary for the housing to have additional openings on any of the other sides. Rather, all that is needed if the installation requires that the exhaust pipe 38 be connected to a side rather than a top, is to rotate the housing 12 ninety degrees.

Located in the front wall 24 of the housing 12 is a substantially round inlet opening 42. The opening 42 lies in a plane parallel to the front wall and communicates with the interior of the housing. While not absolutely necessary, a truncated, conically shaped cone member 44 can extend inwardly into the interior of the housing 12 from the front wall 24. As can be clearly seen from FIG. 1, the truncated cone 44 is comprised of an inner ring 46 and a plurality of straight rods 48 that connects the inner ring 46 to the opening 42.

The connector coupling 14 includes an inlet coupling member 50 at its proximal end which is adapted to be connected directly to the vent outlet of the clothes dryer such as shown in FIGS. 2 and 3. The distal end of the coupling member 14, which extends rearwardly of the dryer 52, includes a substantially conically shaped member 54. The conical end or member 54 is complementary to the truncated, conical member 44 formed in the housing 12. It also includes a ring 56 supported by and secured to the remaining parts of the coupling 14 by a plurality of rods 58. A circular flange 60 separates the conical member 54 from the coupling member 50.

As can be clearly seen in FIG. 1, the connector coupling 14 is adapted to fit within the opening 42 at the front wall 24 of the housing 12. Because of the complementary conical shapes of the distal end 54 of the coupling 14 and the member 44, the coupling member 14 is guided into place into the interior of the housing 12 until the circular flange 60 presses up against the front wall 24 and closes off the opening 42. The side openings in the conical member, however, provides air communications from the dryer 52 into the interior of the housing 12.

A rubber gasket 62 surrounding the opening 42 at the front 24 of the housing 12 seals the flange 60 as it is pressed up against the front wall 24. This provides an airtight seal so that exhaust from the dryer 52 passes through the coupling member 14 into the interior of the housing 12 and out through the coupling 36 into the exhaust pipe 38 without any leaking into the room. Alternatively, the gasket 62 could be mounted on the reverse side of the flange 60.

In order to utilize the vent coupling system 10 of the present invention, the housing 12 is mounted on the room wall 34 in the proper position using the tabs 26 and 28. The correct position is determined by aligning the dryer 52 so that the exhaust vent of the dryer will line up with the opening 42 in the housing 12. The connector coupling 14 is secured to the dryer 52 as shown in FIG. 2. The dryer is then slid back into position where the complementary conical members 54 and 44 properly guide the parts together until they are sealed.

As an additional feature of the invention, the housing 12 can be provided with a means for extinguishing a fire that may occur therein from dryer lint or other debris that might build up. To this end, a fire extinguisher 64 can be mounted to one of the walls, such as wall 16, of the housing. The fire extinguisher 64 is comprised of a canister 66 containing a supply of fire suppressing liquid or gas. The extinguisher 64 includes a nozzle 68 that extends through a suitable opening in the wall 16 and is secured thereto by a nut 70 or other hardware. The nozzle 68 includes a heat sensitive valve that releases the liquid or gas when the temperature in the housing 12 rises above a predetermined level. This could be a mechanical valve or simply a cap or closure made of plastic or wax that melts at the predetermined temperature. Such fire extinguishing devices are, per se, well known in the art as described, for example, in U.S. Pat. Nos. 5,881,819 and 6,105,678.

The present invention may be embodied in other specific forms without departing from the spirit or essential attributes thereof and accordingly, reference should be made to the appended claims rather than to the foregoing specification as indicating the scope of the invention.

I claim:

1. A clothes dryer vent coupling system for connecting the vent outlet of a clothes dryer to an exhaust pipe in a room wall comprises:

a substantially rectangularly shaped housing having four side walls and a front wall and a substantially hollow interior;

means for securing said housing to said room wall with all of said side walls perpendicular to said room wall and said front wall parallel to but spaced away from said room wall;

an outlet coupling mounted on one of the sides of said housing; said outlet coupling being in the form of a tube extending away from said housing but communicating with the interior of said housing;

means for connecting said outlet coupling to said exhaust pipe;

a substantially round inlet opening formed in said front wall of said housing, said inlet opening lying in a plane parallel to said front wall and communicating with the interior of said housing;

a connector coupling including a proximal end and a distal end, said proximal end being connected to said vent outlet of said clothes dryer with said connector coupling extending rearwardly of said dryer, said distal end having a substantially conical shape but with openings therein to communicate with said vent outlet of said dryer;

whereby when said housing is mounted on said room wall and said dryer is moved toward said room wall, said conical-shaped distal end of said connector coupling is guided into and enters said inlet opening, and means for sealing said connector coupling to said inlet opening.

2. The clothes dryer vent coupling system as claimed in claim 1 wherein the four sides of said housing are substantially equal to each other.

3. The clothes dryer vent coupling system as claimed in claim 1 wherein said inlet opening is substantially centered in said front wall.

4. The clothes dryer vent coupling system as claimed in claim 1 wherein said means for sealing includes a gasket positioned around said inlet opening.

5. The clothes dryer vent coupling system as claimed in claim 4 wherein said connector coupling includes a flange thereon.

6. The clothes dryer vent coupling system as claimed in claim 5 wherein said gasket engages said flange and said front wall of said housing.

7. The clothes dryer vent coupling system as claimed in claim 1 further including means for sensing excess heat within said housing.

8. The clothes dryer vent coupling system as claimed in claim 7 further including means for introducing a fire extinguishing agent into said housing in response or said sensing means.

* * * * *